United States Patent [19]

Herbstman et al.

[11] 4,290,778

[45] Sep. 22, 1981

[54] HYDROCARBYL ALKOXY AMINO ALKYLENE-SUBSTITUTED ASPARAGINE AND A MOTOR FUEL COMPOSITION CONTAINING SAME

[75] Inventors: Sheldon Herbstman, Spring Valley; Peter Dorn, LaGrangeville, both of N.Y.

[73] Assignee: Texaco Inc., White Plains, N.Y.

[21] Appl. No.: 204,414

[22] Filed: Nov. 6, 1980

[51] Int. Cl.[3] ..... C10L 1/18; C10L 1/22

[52] U.S. Cl. ..... 44/71; 252/392; 260/501.11

[58] Field of Search ..... 44/71; 252/392; 260/501.11

[56] References Cited

U.S. PATENT DOCUMENTS

| | | | |
|---|---|---|---|
| 4,144,034 | 3/1979 | Cummings | 44/71 |
| 4,144,035 | 3/1979 | Moss | 44/71 |
| 4,204,841 | 5/1980 | Brasotti et al. | 44/71 |
| 4,207,079 | 6/1980 | Herbstman et al. | 44/71 |

*Primary Examiner*—Jacqueline V. Howard

*Attorney, Agent, or Firm*—Carl G. Ries; Robert A. Kulason; James J. O'Loughlin

[57] ABSTRACT

A primary hydrocarbyl alkoxy amino alkylene-substituted asparagine represented by the formula:

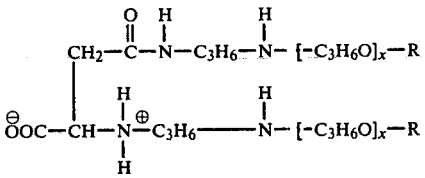

in which R is a primary hydrocarbon radical having from about 8 to 24 carbon atoms and x has a value from 1 to 10 is provided and a motor fuel composition containing same.

13 Claims, No Drawings

HYDROCARBYL ALKOXY AMINO ALKYLENE-SUBSTITUTED ASPARAGINE AND A MOTOR FUEL COMPOSITION CONTAINING SAME

BACKGROUND OF THE INVENTION

1. Field of the Invention

Gasoline compositions are highly refined products. Despite this, they contain minor amounts of impurities which can promote corrosion during the period that the fuel is transported in bulk or held in storage. Corrosion can also occur in the fuel tank, fuel lines and carburetor of a motor vehicle. As a result, a commercial motor fuel composition must contain a corrosion inhibitor to inhibit or prevent corrosion.

Internal combustion engine design is undergoing changes to meet new standards for engine exhaust gas emissions. One design change involves the feeding of blow-by gases from the crankcase zone of the engine into the intake air supply to the carburetor rather than venting these gases to the atmosphere as in the past. Another change involves recycling part of the exhaust gases to the combustion zone of the engine in order to minimize objectionable emissions. Both the blow-by gases from the crankcase zone and the recycled exhaust gases contain significant amounts of deposit-forming substances which promote the formation of deposits in and around the throttle plate area of the carburetor. These deposits restrict the flow of air through the carburetor at idle and at low speeds so that an overrich fuel mixture results. This condition produces rough engine idling or stalling causing an increase in the amount of polluting exhaust gas emisions, which the engine design changes were intended to overcome, and decreasing fuel efficiency.

Certain N-alkyl-alkylene diamine compounds, as represented by N-oleyl-1,3-diaminopropane, are known to give carburetor detergency properties to gasoline. These additives, however, do not impart corrosion inhibiting properties to gasoline. As a result, a motor fuel containing an N-alkyl-alkylene diamine must be further modified or supplemented with another additive in order to have the necessary corrosion inhibiting properties for marketability.

DESCRIPTION OF THE PRIOR ART

U.S. Pat. No. 3,773,479 discloses a motor fuel composition containing an alkyl-substituted asparagine having the formula:

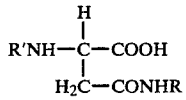

in which R and R′ each represent secondary or tertiary alkyl radicals having from 7 to 20 carbon atoms. The corresponding compounds in which R and R′ are straight chain radicals are too insoluble in gasoline to be effective as an additive.

U.S. Pat. No. 4,144,034 discloses a motor fuel composition containing the reaction product of an aliphatic ether monoamine and maleic anhydride.

SUMMARY OF THE INVENTION

A novel hydrocarbyl alkoxy amino-alkylene-substituted asparagine compound is provided which is useful as a multifunctional additive when employed in a liquid hydrocarbon fuel for an internal combustion engine. The compound, which is produced by reacting about two moles of a hydrocarbyl alkoxy alkylene diamine with a mole of maleic anhydride to produce a compound characterized by having a plurality of alkoxy and amino groups, exhibits surprising corrosion inhibiting properties as well as essential carburetor detergency properties when employed in gasoline. This finding of multifunctionality is surprising in itself and also contrasts with the discovery in U.S. Pat. No. 3,773,479 which discloses that there is selectivity in the effectiveness of derivatives of maleic anhydride.

The fuel composition of the invention prevents or reduces corrosion problems during the transportation, storage and the final use of the product. The gasoline of the invention also has highly effective carburetor detergency properties. When a gasoline of the invention is employed in a carburetor which already has a substantial build-up of deposits from prior operations, a severe test of the carburetor detergency property of a fuel composition, this motor fuel is effective for removing substantial amounts of the preformed deposits.

DESCRIPTION OF THE PREFERRED EMBODIMENTS

The hydrocarbyl alkoxy amino alkylene-substituted asparagine of the invention is represented by the formula:

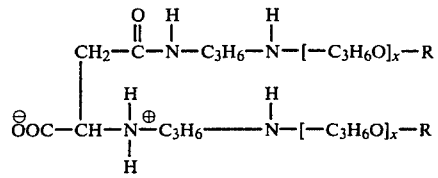

in which R represents an aliphatic hydrocarbon radical having from 8 to 24 carbon atoms and x has a value from 1 to 10. A preferred compound of the invention is one in which R is a straight chain primary aliphatic hydrocarbon radical having from about 10 to 20 carbon atoms and x has a value from 1 to 5. A particularly preferred compound is one formed from a straight chain monovalent aliphatic hydrocarbon radical having from about 14 to 18 carbon atoms and x has a value from about 1.5 to 4.

A preferred compound is represented by the formula:

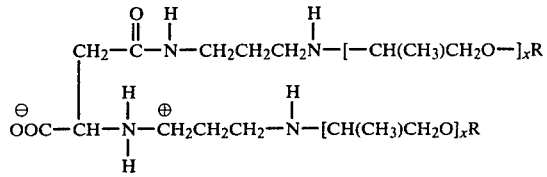

in which R and x have the value noted above.

The novel compound of the invention is prepared by reacting a hydrocarbyl alkoxy diamine, an ether amine, with maleic anhydride. Approximately two moles of the hydrocarbyl alkoxy alkylene diamine are reacted with a mole of maleic anhydride at a temperature ranging from about room temperature up to about 110° C. maximum, preferably from about 60° to 100° C. The upper temperature limit in the preparation of the additive is critical. Higher temperatures especially above 110° C. cause the formation of succinimide compounds which have essentially no corrosion inhibiting properties for a motor fuel composition.

The hydrocarbyl alkoxy alkylene diamine reactant can be represented by the formula:

$$R\text{-}[OCH_2CH(CH_3)]_x\text{—}NH\text{—}C_3H_6\text{—}NH_2$$

in which R represents the aliphatic hydrocarbon radical described above. Preferred hydrocarbyl alkoxy alkylene diamines are those in which R is a straight chain primary aliphatic hydrocarbon radical.

Examples of suitable hydrocarbyl alkoxy alkylene diamines include:

N-1-[n-$C_{16-18}$ alkyl isopropoxy]-1,3-propane diamine
N-1-[n-$C_{12-14}$ alkyl isopropoxy]-1,3-propane diamine
N-1-[n-octylisopropoxy]-1,3-propane diamine
N-1-[n-dodecyl(isopropoxy)$_3$]-1,3-propane diamine
N-1-[n-octadecyl(isopropoxy)$_5$]-1,3-propane diamine This reaction is illustrated by the following formula:

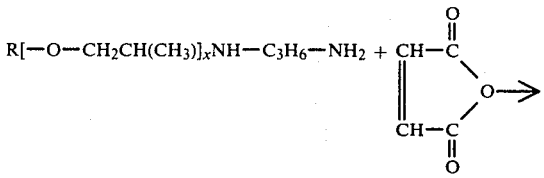

in which R and x have the values noted above.

Examples of specific compounds of the invention produced in this reaction which are effective as multifunctional gasoline additives include the following:

N-N'-di-(3-n-dodecyloxypropylamino-1-propyl) asparagine
N-N'-di-(3-n-$C_{16}$-$C_{18}$-alkylisopropoxylamino-1-propyl) asparagine
N-N'-di-(3-n-$C_{12}$-$C_{14}$-alkylisopropoxylamino-1-propyl) asparagine
N-N'-di-(3-n-octylisopropoxylamino-1-propyl) asparagine
N-N'-di-(3-n-dodecyl(isopropoxyl)$_3$-amino-1-propyl) asparagine
N-N'-di-(3-n-octadecyl(isopropoxyl)$_5$-amino-1-propyl) asparagine
N-N'-di-(3-n-isodecyloxypropylamino-1-propyl) asparagine It will be appreciated that by-products and/or impurities can be co-produced along with the compound of the invention in this reaction. The desired additive compounds can be readily recovered from the reaction product by known methods. However, it is feasible and economical to employ the prescribed compounds as produced without separation or purification.

The following examples illustrate methods for preparing the additive of the invention:

EXAMPLE I 16 grams of maleic anhydride (0.159 mole) are suspended in 115.6 grams mineral oil having an SUS at 100° F. of 100 and with stirring and nitrogen purge is heated at 100° C. for 1 hours. N-1-[n-$C_{16}$-$C_{18}$ alkyl (isopropoxyl)$_{4.1}$]-1,3-propane diamine, 100 grams, (0.32 mole) is introduced into the oil solution at 100° C. over 0.5 hour. The reaction mixture is stirred at 100° C. for an additional 2 hours. The reaction product was filtered hot to yield 231 grams of a pale yellow liquid.

Analysis of the 50 percent oil solution of the additive was as follows:

N, wt. % 2.8

The compound produced is represented by the formula:

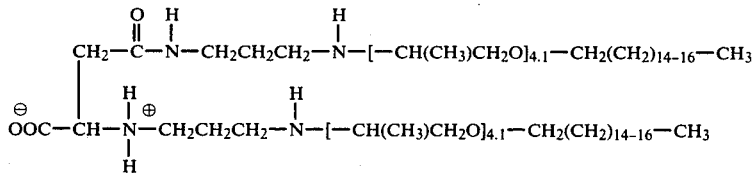

EXAMPLE II 24.5 grams (0.25 mole) of maleic anhydride were added to 197.8 grams of mineral oil having an SUS at 100° F. of 100 and heated to about 100° C. under a nitrogen atmosphere. 173 grams, 0.5 mole of N-1-(n-$C_{12}$-$C_{14}$ alkoxy propylene)-1,3-propane diamine were added over one hour at 90°-100° C. The reaction conditions were maintained for 2 hours at which time the reaction product was cooled and filtered to recover light a light yellow liquid. As a 50 wt. % solution in mineral oil, the reaction product had the following analysis:

| | |
|---|---|
| TBN | 113 |
| TAN | 33.2 |
| % N wt. % | 3.5 |

This product is represented by the formula:

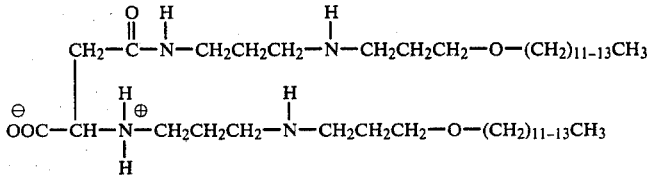

EXAMPLE III

The ether-amine represented by the formula:

$$CH_3(CH_2)_{8-10}—CH_2\text{-}[O\text{-}CH_2CH(CH_2)]_{1.75}NHCH_2CH_2CH_2NH_2$$

was reacted with maleic anhydride following the procedure employed in Example I. A substantial yield of the reaction product represented by the formula:

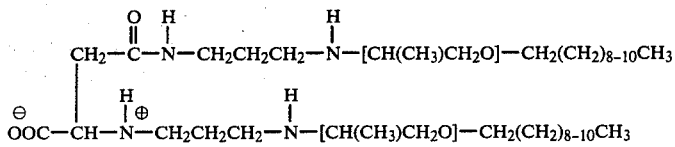

The base fuel, which is useful for employing the additive of the invention, is a mixture of hydrocarbons boiling in the gasoline boiling range. This base fuel may consist of straight-chain or branched-chain paraffins, cycloparaffins, olefins, and aromatic hydrocarbons, and any mixture of these. The base fuel can be derived from straight-run naphtha, polymer gasoline, natural gasoline or from catalytically reformed stocks and boils in the range from about 80° to 450° F. The composition and the octane level of the base fuel are not critical and any conventional motor fuel base can be employed in the practice of this invention.

In general, the additive of the invention is added to the base fuel in a minor amount, i.e., an amount effective to provide both corrosion inhibition and carburetor detergency to the fuel composition. The additive is effective in an amount ranging from about 0.0002 to 0.2 weight percent based on the total fuel composition. An amount of the neat additive ranging from about 0.001 to 0.01 weight percent is preferred, with an amount from about 0.001 to 0.007 being particularly preferred, the latter amounts corresponding to about 3 to 20 PTB (pounds of additive per 1000 barrels of gasoline) respectively.

The fuel composition of the invention may contain any of the additives normally employed in a motor fuel. For example, the base fuel may be blended with an anti-knock compound, such as a methyl-cyclopentadienyl manganese tricarbonyl or tetraalkyl lead compound, including tetraethyl lead, tetramethyl lead, tetrabutyl lead, and chemical and physical mixtures thereof, generally in a concentration from about 0.025 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide.

Gasoline blends were prepared from a typical base fuel mixed with specified amounts of the prescribed fuel additive of the invention. These fuels were then tested to determine the effectiveness of the additive in gasoline together with comparison fuels in the following performance tests.

The base fuel employed with the additive of the invention in the following examples was an unleaded grade gasoline having a Research Octane Number of about 93. This gasoline consisting of about 33 percent aromatic hydrocarbons, 7 percent olefinic hydrocarbons and 60 percent paraffinic hydrocarbons and boiled in the range from 90° to 375° F.

The rust inhibiting properties of fuel compositions of the invention was determined in the NACE Test (National Association of Corrosion Engineers) which is a modification of ASTM Rust Test D-665-60 Procedure A. In the NACE Test, a steel spindle is polished with non-waterproof fine emery cloth. The spindle is immersed in a mixture containing 300 cc fuel and 30 cc distilled water and is rotated at 100° F. for 3.5 hours. The spindle is then rated visually to determine the amount of rust formation. A passing result is an average of less than 5% rust.

The results of this test are set forth in Table I below:

TABLE I

| | | NACE RUST TEST | |
|---|---|---|---|
| Run | Additive | Concentration, PTB[1] | Percent Rust |
| 1 | Example I | 10.0 | Trace to 1 |
| 2 | Example II | 10.0 | Trace |
| 3 | Example III | 10.0 | Trace |

[1]PTB = pounds of additive per 1000 barrels of fuel (unleaded gasoline).

The foregoing data shows that the novel etheramine reaction product of the invention was highly effective as a corrosion inhibitor in the NACE Test even at the lowest concentrations.

The additive of the invention was tested as a carburetor detergent in the Chevrolet Carburetor Detergency Test. This test is run on a Chevrolet V-8 engine mounted on a test stand using a modified four barrel carburetor. The two secondary barrels of the carburetor are sealed and the feed to each of the primary barrels arranged so that an additive fuel can be run in one barrel and the base fuel run in the other. The primary carburetor barrels were also modified so that they had removable aluminum inserts in the throttle plates area in order that deposits form on the inserts in this area could be conveniently weighed.

In the procedure designed to determine the effectiveness of an additive fuel to remove preformed deposits in the carburetor, the engine is run for a period of time usually 24 to 48 hours using the base fuel as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blow-by to the inlet in the carburetor body. The inserts are then removed from the carburetor and weighed to determine the difference beween the performance of the additive and reference fuels in removing the preformed deposits. After the aluminum inserts are cleaned, they are replaced in the carburetor and the process repeated with the fuels reversed in the carburetor to minimize differences in fuel distribution and barrel construction. The deposit weights in the two runs are averaged and the effectiveness of the fuel composition of the invention is compared to the reference fuel which contains an effective detergent additive. The difference in effectiveness is expressed in percent.

The carburetor detergency test results obtained with the fuel composition of the invention in comparison to the base fuel and to two commercial detergent fuel compositions was obtained at the same detergent additive concentration, i.e. 20 PTB. The comparison commercial fuels are identified as Reference Fuel A and Reference Fuel B. The results are set forth in the table below:

TABLE II

CHEVROLET CARBURETOR DETERGENCY TEST

| Run | Additive Fuel Composition | % Wash Down (Removal) of Preformed Deposits[1] |
|---|---|---|
| 1 | Base Fuel | +10[2] |
| 2 | Reference Fuel A | −62 |
| 3 | Base Fuel + 20 PTB Ex. I | −88 |
| 4 | Base Fuel + 20 PTB Ex. II | −68 |

[1]Built up with base fuel.
PTB = Pounds of Additive per 1000 Barrels of fuel based upon 100% active material (additive neat).
[2]"+" Denotes a deposit build-up.

The above data shows that the fuel composition of the invention was highly effective in the Chevrolet Carburetor Detergency Test with results equal or superior to that obtained using a commercial detergent fuel composition.

The foregoing tests establish that the prescribed novel additive of the invention is an outstandingly effective multifunctional additive for a motor fuel composition and that the blended gasoline compositions containing same possess a high level of corrosion inhibition and carburetor detergency properties.

We claim:

1. The compound represented by the formula:

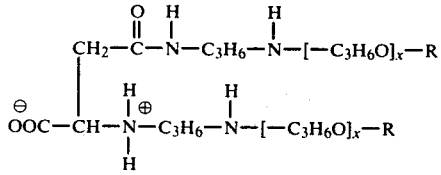

in which R represents an aliphatic hydrocarbon radical having from 8 to 24 carbon atoms and x has a value from 1 to 10.

2. The compound represented by the formula:

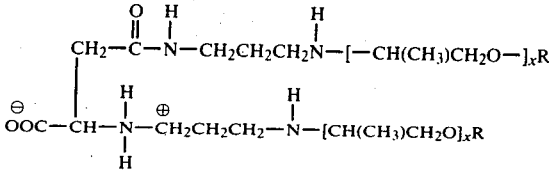

in which R is an aliphatic hydrocarbon radical having from 10 to 20 carbon atoms and x has a value from 1 to 5.

3. N-N'-di-(3-n-dodecyloxypropylamino-1-propyl) asparagine.

4. N-N'-di-(3-n-$C_{16}$–$C_{18}$-alkylisopropoxylamino-1-propyl) asparagine.

5. N-N'-di-(3-n-$C_{12}$–$C_{14}$-alkylisopropoxylamino-1-propyl) asparagine.

6. N-N'-di-(3-n-octylisopropoxylamino-1-propyl) asparagine.

7. A motor fuel composition comprising a mixture of hydrocarbons in the gasoline boiling range containing from about 0.0002 to 0.2 weight percent of an additive represented by the formula:

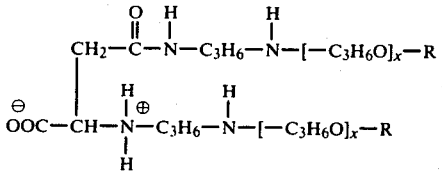

in which R represents an aliphatic hydrocarbon radical having from 8 to 24 carbon atoms and x has a value from 1 to 10.

8. A motor fuel composition according to claim 7 in which said compound is represented by the formula:

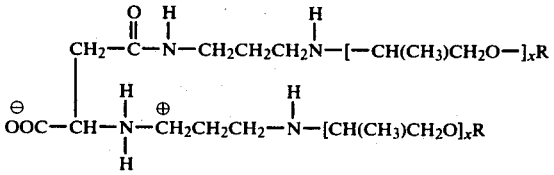

in which R is a straight chain primary aliphatic hydrocarbon radical having from 10 to 20 carbon atoms and x has a value from 1 to 5.

9. A motor fuel composition according to claim 7 in which said compound is N-N'-di-(3-n-decyloxypropoxylamino-1-propyl) asparagine.

10. A motor fuel composition according to claim 7 in which said compound is N-N'-di-(3-$C_{16}$–$C_{18}$-alkylisopropoxyl(amino-1-propyl) asparagine.

11. A motor fuel composition according to claim 7 in which said compound is N-N'-di-(3-octadecyloxypropylamino-1-propyl) asparagine.

12. A motor fuel composition according to claim 7 in which said compound is N-N'-di-(3-dodecyl(isopropyl)$_3$-amino-1-propyl) asparagine.

13. A motor fuel composition according to claim 7 containing from about 0.001 to 0.01 weight percent of said additive.

* * * * *